US005113447A

United States Patent [19]

Hatley et al.

[11] Patent Number: 5,113,447

[45] Date of Patent: May 12, 1992

[54] METHOD AND SYSTEM FOR OPTIMIZING AUDIO IMAGING IN AN AUTOMOTIVE LISTENING ENVIRONMENT

[75] Inventors: Brian J. Hatley, Lynnwood; Richard A. Chinn, Redmond, both of Wash.

[73] Assignee: Electronic Engineering and Manufacturing, Inc., Mountlake Terrace, Wash.

[21] Appl. No.: 461,186

[22] Filed: Jan. 5, 1990

[51] Int. Cl.[5] ..... H04S 3/00

[52] U.S. Cl. ..... 381/27

[58] Field of Search ..... 381/27, 1, 24

[56] References Cited

U.S. PATENT DOCUMENTS 3,478,167 11/1969 Sorkin ..... 179/1

3,632,886 1/1972 Scheiber ..... 179/15 BT 3,746,792 7/1973 Scheiber ..... 179/1 GQ 4,747,142 5/1988 Tofte ..... 381/27

*Primary Examiner*—Forester W. Isen

*Attorney, Agent, or Firm*—Seed and Berry

[57] ABSTRACT

An audio system having an improved sound field by generating a center audio channel from left and right stereo channels. The center channel is preferably generated by summing the left and right channels, and then filtering the resulting output. The center channel signal is also combined with the left and right channel signals to remove a portion of the monophonic information from the left and right channels thereby maintaining a constant level of monophonic information in the sound field.

9 Claims, 7 Drawing Sheets

From B
.5(L-R)
150
154
502
504
506
High
Mid
Low
510
512
514
516
518
520
522
524
525
526
528
530
534
536
538
540
541
544
508
509
To C
.5(R-L)

V+
274
274'
277
400
400'
406
406'
408
408'
386'
388
388'
402'
410
410'

METHOD AND SYSTEM FOR OPTIMIZING AUDIO IMAGING IN AN AUTOMOTIVE LISTENING ENVIRONMENT

FIELD OF THE INVENTION

This invention relates to the field of audio signal processing and more specifically to a method and system for optimizing the audio image perceived by a driver and passengers in an automotive listening environment.

BACKGROUND OF THE INVENTION

Audio systems have become increasingly popular in recent years, and much development effort has been directed toward improving the quality and integrity of their audio imaging. One important aspect of audio imaging is the creation of a sound field in which a listener perceives depth and directional qualities in the sound field created by a plurality of sources.

One example of a multi-channel audio system which provides an enhanced sound field is described in U.S. Pat. Nos. 3,632,886, 3,746,792, and 3,959,590, all invented by Scheiber. In Scheiber's system, as many as four audio channels may be encoded to two channels for recording or transmission and decoded at playback to produce multiple channels (typically four) of audio information. In this type of system, speakers or transducers are placed peripherally around a listener to produce a sound field in which sound may be perceived as originating from substantially any direction.

Another example of a multi-channel audio system which provides an enhanced sound field is the well known "surround sound" audio system designed by Dolby Laboratories. In this system, multiple channels of audio information are also encoded to two channels for recording and decoded at playback to produce a multi-dimensional sound field. In this system, the primary sound sources are located in front of a listener and secondary sound sources are disposed peripherally around a listener to create the desired directional effects. This system is particularly popular for use with the audio portions of motion pictures.

Still another multi-channel sound system is described in U.S. Pat. No. 4,478,167, invented by Borkin. Borkin teaches a three channel sound system in which speakers are located in a triangular pattern around a listener. In Borkin's system, a center channel signal is derived by summing a portion of left side channel signal and a portion of the right side channel signal. In addition, a portion of the right side signal is cancelled from the left side channel and a portion of the left side signal is cancelled from the right side channel. According to Borkin, the proportions of the amount of side channel cancellation range from approximately $\frac{2}{3}$–$\frac{3}{4}$ to achieve the desired results. In Borkin's system, the gain of each of the audio channels is identical and fixed, thus requiring transducers of equal size wherein the placement of the transducers relative to the listener is critical.

While each of the above systems provides an enhanced sound field in a spacious environment such as a home living room or movie theater, they are not particularly useful for use in an automotive environment. As exemplified by the systems noted above, much development effort has been directed toward bolstering the directional information present in a sound field and the above systems function quite well in installations where sound sources and listeners can be positioned in optimal locations. However, in an automotive environment, the location of listeners relative to sound sources cannot be readily adjusted. For example, sound sources in automobiles are typically placed in doors, side panels or rear decks, and once installed, cannot be moved. The position of the listeners, in this case a driver and one or more passengers, is necessarily fixed by the location of seats within the automobile. If the sound system is adjusted to produce a balanced sound field proximate either the driver or passengers, the sound field will be unbalanced near the other occupants of the automobile. No system is known which allows a sound field to be optimized for one occupant of an automobile while also providing an optimally balanced sound field for the other occupants of an automobile. Furthermore, no system is known which generates a balanced sound field in a center channel sound system wherein the components used in the center channel may be smaller than the side channel components and further wherein the placement of the center channel transducer is not critical.

SUMMARY AND OBJECTS OF THE INVENTION

Briefly described, the present invention contemplates an audio system for optimizing a sound field for a plurality of listeners positioned in diverse locations in a listening environment. In operation, first and second audio signals, typically comprising left and right audio signals, are input from an audio source. The first and second audio channels are summed to generate a composite audio signal. A portion of the composite audio signal is cancelled from the left and right audio signals to generate left and right output signals, respectively, wherein the composite audio signal comprises a center channel output signal. In one aspect of the present invention, the gain of the side channel cancellation signal is limited to 0.5 to preserve substantially all of the perceptible directional information in the left and right side channels. In yet another aspect of the present invention, the center channel output signal is high-pass filtered to remove low frequency information from the center channel thus allowing a relatively smaller transducer to be used in the center channel. In yet another aspect of the present invention, the overall gain of the center channel is adjustable to allow the sensitivity of the center channel to be adjusted to match the center channel components to the other components used in the system.

In an alternate embodiment of the present invention, means are provided for deriving left and right channel ambience signals wherein the ambience signals comprise the respective difference signals for each channel. Means are provided for injecting variable amounts of the left and right ambience signals into the left and right output signals, respectively, to provide a center channel stereophonic system having complete control over the level of difference signal information present in the respective side channels.

Accordingly, it is an object of the present invention to provide a method and system for providing an optimally balanced sound field for a plurality of listeners in diverse listening locations.

It is another object of the present invention to provide a method and system for evenly re-distributing the monophonic portion of a stereophonic sound field while leaving a substantial portion of the directional information intact.

It is yet another object of the present invention to provide a center channel in stereophonic sound system wherein the placement of the center channel transducer is not critical.

It is still another object of the present invention to provide a multi-channel sound system for optimizing the sound field for a plurality of listeners in an automotive listening environment.

It is yet another object of the present invention to provide a method and system for evenly redistributing the monophonic portion of a stereophonic sound field while also providing means for controlling the level of directional information present in the respective side channel signals.

BRIEF DESCRIPTION OF THE DRAWINGS

These and objects will be readily apparent to persons of ordinary skill through the detailed description of the invention below and the accompanying drawings in which.

DETAILED DESCRIPTION OF THE INVENTION

Figure 1A:
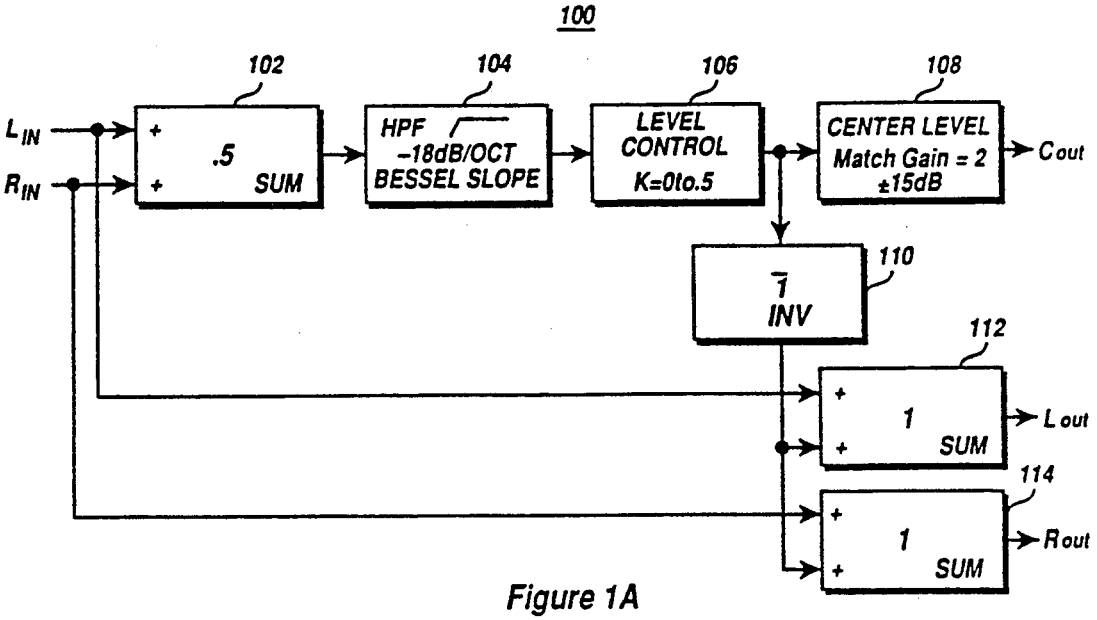
FIG. 1A is a block diagram of the improved audio system of the present invention.
Figure 1B:
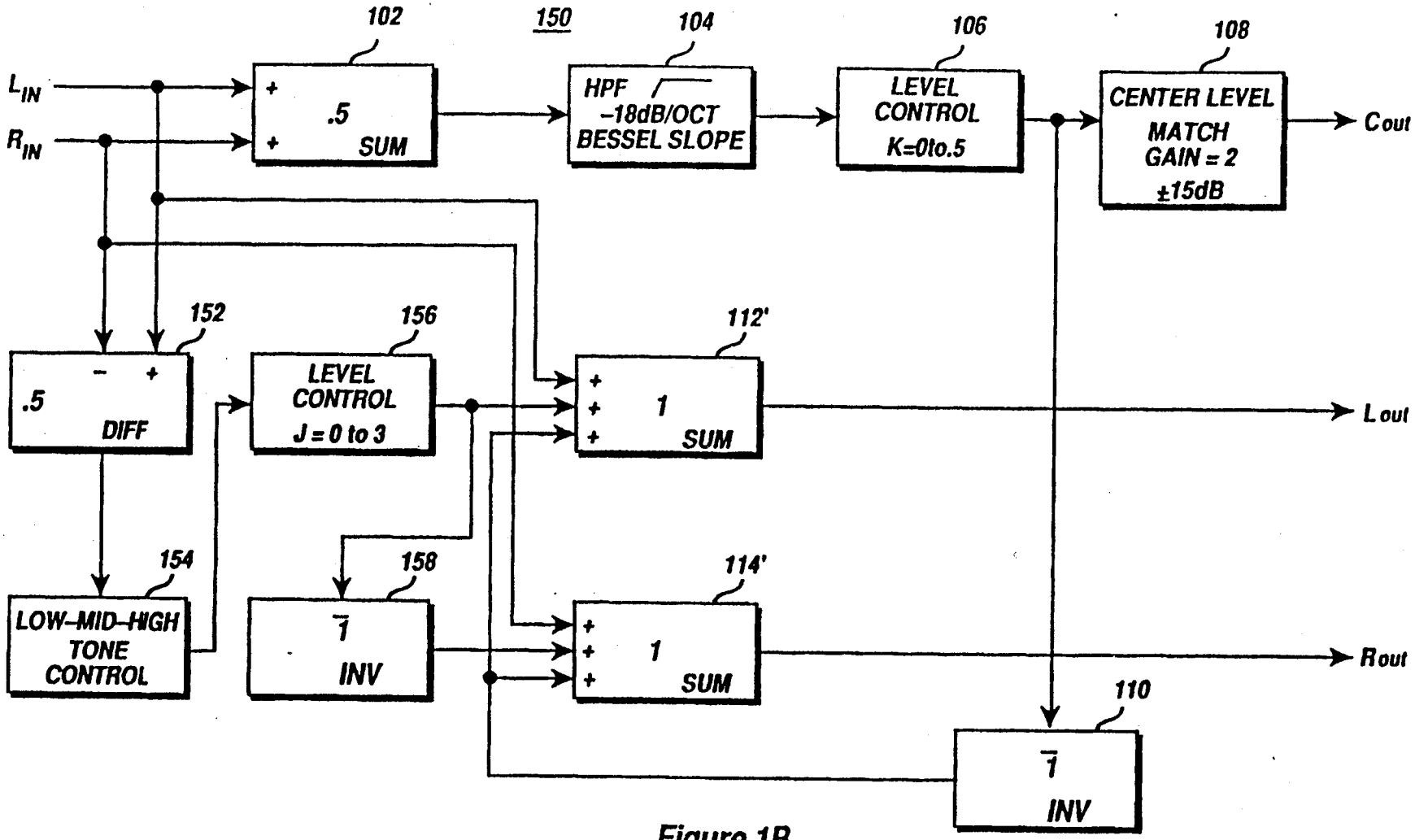
FIG. 1B is a block diagram of an alternate embodiment of the present invention.

FIG. 1 is a block diagram of the preferred embodiment of the present invention. In the system 100, first and second channels of audio information, typically referred to as left and right side channels, are coupled to a summing means 102 which generates a combined left plus right (L+R) audio signal. In the preferred practice of the present invention the summing means 102 limits the gain of the combined L+R audio signal to 0.5. The output of summing means 102 is coupled to high pass filter 104 which blocks low frequency information in the combined L+R audio signal. The high pass filter 104 is preferably a conventional highly damped Bessel slope filter having a slope of approximately −18dB/oct. The output of high pass filter 104 is coupled to level control 106 which adjusts the gain of the combined L+R audio signal to limit the level of monophonic information in the center channel to a desired amount. The output of level control 106 is coupled to a level matching network 108 which allows the overall gain of the combined L+R audio signal to be adjusted to match the sensitivity of the output components used in the left and right side channels.

The output of level control 106 is further coupled to phase inverter 110 which shifts the phase of the combined L+R audio signal by 180 degrees. The output of phase inverter 110 is further coupled to summing means 112, 114 which sums the inverted, gain limited, high pass filtered L+R audio signal with the respective left and right side channel signals to remove a portion of the monophonic center channel information from the left and right side channels, thus providing and maintaining a constant level of monophonic information in the overall sound field. While the system 100 is shown as incorporating an inverter 110, those skilled in the art will appreciate that the inverter 110 may be incorporated in summing means 112, 114 by providing summing means with inverting and non-inverting inputs.

The relationship of the respective center and side channels of the system 100 is defined by the following equations:

$$L=L-K(L+R)$$

$$R=R-K(L+R)$$

$$C=2K(L+R)$$

where:

L=left side signal

R=right side signal

K=monophonic cancellation gain (limited to K=0.5)

2K=center channel output gain

In practice, the variable gain center channel provides the following output relationships:

| CENTER SETTING | K | LEFT CHANNEL | RIGHT CHANNEL | CENTER CHANNEL | SEPARATION LIMIT |
|---|---|---|---|---|---|
| 0% | 0 | L | R | 0 | MAX |
| 50% | .25 | .875L −.125R | .875R −.125L | .25 (L + R) | 17dB |
| 100% | .5 | .72L −.25R | .75R −.25L | .5 (L + R) | 9.5dB |
| 200% (limit) | 1 | .5L − .5R | .5R − .5L | L + R | 0dB |

Referring now to FIF. 1B, in another embodiment of the present invention, the system 150 includes means for controlling the "ambience" of a sound field. For the sake of clarity in the description below, items which perform identical functions bear identical designations. An ambience signal may be thought of as a side channel difference signal wherein the frequency response of the difference signal may be modified. After processing, the ambience signal is injected into the left and right side channels in a variable amount to achieve a desired effect. In practice, the ambience signal for the left side channel comprises a (L−R) difference signal and ambience signal for the right side channel comprises a (R−L) difference signal. In the system 150, a left minus right (R−L) signal is derived by difference signal generator 152. In the preferred practice of the present invention, the gain of the difference signal generator 152 is limited to 0.5 to prevent clipping distortion of maximum amplitude input signals at the difference amplifier output. The output of difference signal generator 152 is coupled to tone control 154 which alters the frequency response of the difference signal. The output of tone control 154 is coupled to level control 156 which controls the amount of ambience signal added to the respective left and right side channel signals. The output of level control 156 is coupled to an inverter circuit 158 which generates the right minus left (R−L) ambience signal. The system 150 incorporates three input summing circuits 112', 114' which are essentially identical to summing circuits 112, 114 with the addition of an additional input. In the system 150, the center channel signal is derived in an identical manner as the system 100. The processed left and right side channel signals are generated in a similar manner as the system 100 wherein summing circuit 112' sums the output of inverter 110 (which comprises the inverted or phase shifted center channel signal), the left side channel signal, and the L−R ambience signal. Similarly, the summing circuit 114 sums the output signals of inverter 110, inverter 158 (which comprises the R−L ambience signal) and the right side channel signal. The following equations define the relationships between the input and output signals in the system 150.

$$C=K(0.5L+0.5R)$$

$$L=(0.5JL-0.5JR)-K(0.5L+0.5R)=L-K(0.5L+0.5R)$$

$$R=(0.5JR-0.5JL)-K(0.5L+0.5R)=R-K(0.5R-0.5L)$$

where:

C=center signal
L=left side signal
R=right side signal
K=monophonic cancellation gain (limited to K=0.5(K=0−5))
J=ambience injection gain (J=(0−3))

Figure 2:
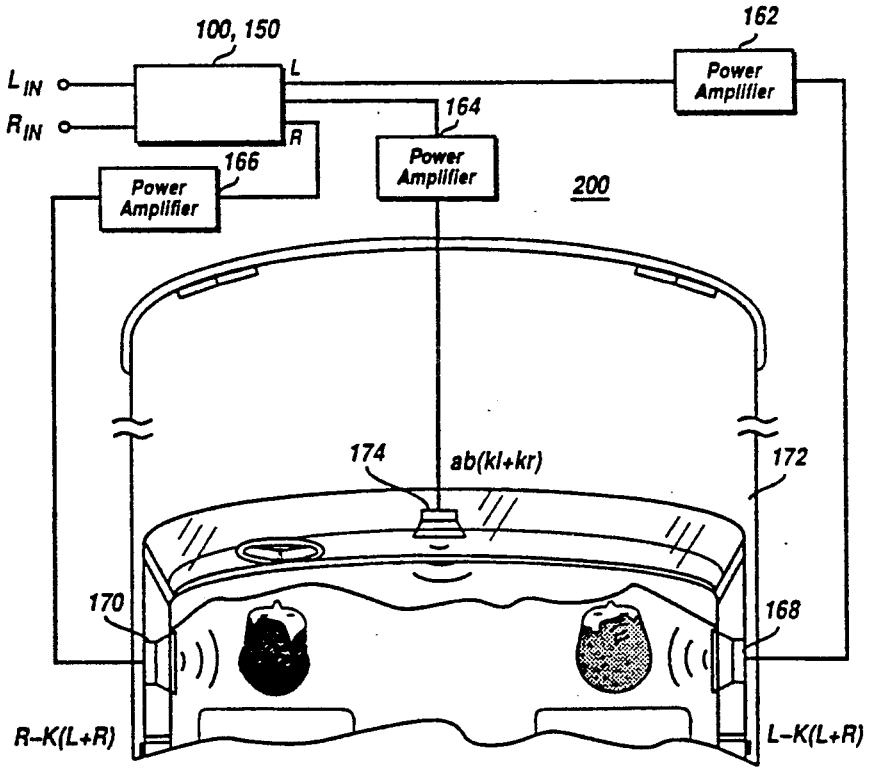
FIG. 2 is a diagram of one possible transducer arrangement in an automotive listening environment in accordance with the principles of the present invention.

A typical installation for the improved audio system of the present invention is shown in FIG. 2. In the installation 200, the system 100 typically receives audio left and right input signals from an audio source (not shown) such as the output of a cassette deck, compact disk player, tuner, etc. Depending on the specific application, other components such as an equalizer or a preamplifier may be inserted in series between the audio source and the system 100. The system 100 processes the left and right input signals to generate left side channel, right side channel and center channel signals which are amplified by power amplifiers 162–166, respectively. Transducers 168, 170, coupled to the respective outputs of power amplifiers 162, 170 are typically of the same size and sensitivity and would typically be mounted in the doors, side panels, or rear deck of automobile 172. However, in an automobile, options for locating a center channel transducer are quite limited. Therefore, the present invention contemplates the use of a frequency limited center channel to allow a reduced size transducer 174 which may be mounted in a variety of locations such as an automobile dashboard where space is limited. The present invention further provides a variable gain center channel so that the sensitivity of transducer 174 can be compensated to match the sensitivity of transducers 168, 170.

As can be seen in FIG. 2, without the center channel transducer 174, each of the passengers in automobile 172 is located in a position proximate a single side channel transducer. Thus, stereophonic imaging is minimized since each listener primarily hears the side channel closest to the listener. With the addition of the side channel transducer 174, a portion of the signal from each of the side channels is relocated to the center of the automobile 172 thus improving the image perceived by both passengers.

Figure 3A:
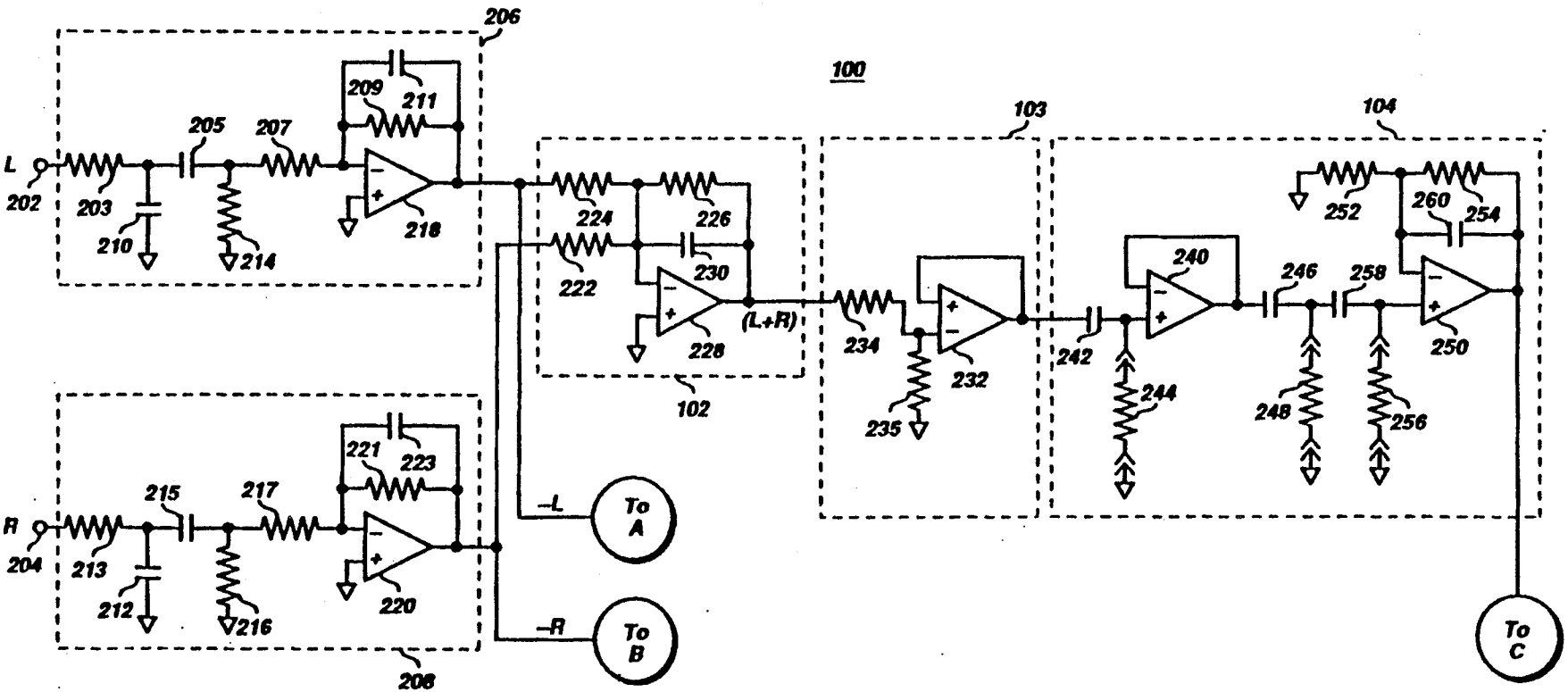
FIG. 3A is a schematic diagram of a portion of the system of FIG. 1A.

Referring now to FIG. 3A, the system 100 receives left and right audio signals at terminals 202, 204, respectively. Input filters 206, 208, coupled to terminals 202, 206, respectively, provide noise filtering and input isolation. Input filter 206 comprises operational amplifier 218 which is disposed with an inverting input coupled to input terminal 202 through a broad bandpass filter formed by resistors 203, 207, and 214, and capacitors 205 and 210. Gain control feedback resistor 209 and filter capacitor 211 are connected in parallel between the output and the inverting input of operational amplifier 218. Input filter 208 is identical to input filter 206 and it includes resistors 213, 216, 217, 221, capacitors 212, 215, 223 and amplifier 220. The respective components of input filters 206, 208 are selected to provide a bandpass filter response of approximately 1 Hz–200 KHz.

The outputs of input filters 206, 208 comprise inverted left and right (−L,−R) input signals which are coupled to inverting summing network 102. Summing network 102 generates a composite (L+R) sum signal of the inverted left and right input signals. Summing network 102 includes resistors 222, 224, resistor 226, capacitor 230 and operational amplifier 228 wherein summing network 102 is configured to provide a gain of approximately 0.5. Summing network 102 provides a relatively low impedance to the input sources to minimize distortion and to scale the input voltage to preserve the dynamic range in the system.

The output of summing network 102 is coupled to a voltage follower 103 which comprises operational amplifier 232 and resistors 234, 235. Voltage follower 103 reduces the gain of the composite L+R signal to compensate for the gain in following stages. The output of voltage follower 103 is coupled to the input of high pass filter 104 through coupling and filter capacitor 242. High pass filter 104 blocks any low frequency information in the composite L+R signal.

The high pass filter 104 is preferably configured as a 3rd order steep slope bessel type filter having a slope of approximately 18 dB/oct. High pass filter 104 comprises operational amplifier 240, resistor 244, and capacitors 242, 246; and operational amplifier 250, resistors 252, 254, 256, capacitor 258 and stabilizing capacitor 260. In the preferred practice of the present invention, resistors 244, 248, 256 may be of the switchable dip resistor network type to adapt the frequency response of the system 100 for use with virtually any type of transducer and amplifier system. In the preferred practice of the present invention, the components are preferably selected to provide a cutoff frequency which may range from 20–350 Hz depending on the values of resistors 244, 248 and 256 with the frequency being chosen based on the low frequency characteristics of the center channel transducer.

Figures 3B, 3C:
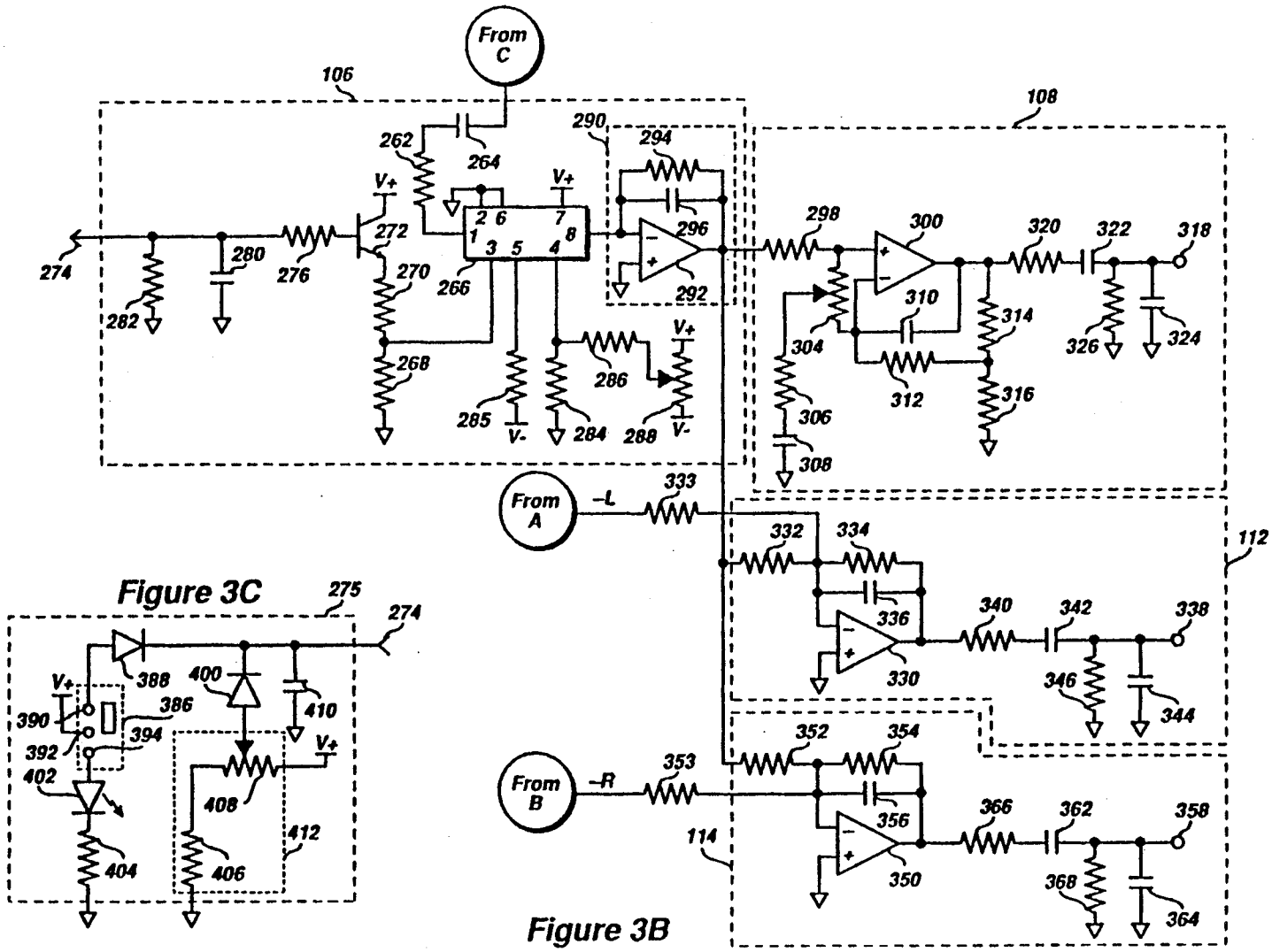
FIG. 3B is a schematic diagram of another portion of the system of FIG. 1A.
FIG. 3C is a schematic diagram of a circuit for remotely controlling the system of FIG. 1A.

Referring now to FIG. 3B, the output of high pass filter 104 is coupled to the input of level control 106 through voltage-to-current converting resistor 262 and AC coupling capacitor 264 which is selected to pass any AC signal above 10 Hz without any significant attenuation. Level control 106 preferably comprises a 2150A voltage controlled amplifier (VCA) 266, manufactured by That Corporation, 15 Strathmore Rd., Natick, Mass. 01760. VCA 266 receives the current signal generated by resistor 262 and amplifies the current signal under the control of the voltage produced across resistors 268, 270 which form a 1:50 voltage divider. The voltage produced across resistors 268, 270 is controlled by NPN transistor 272 which is disposed with its emitter coupled to one terminal of resistor 270 and its collector coupled to the V+ positive voltage source. The base of transistor 272 is coupled to control terminal 274 through resistor 276 wherein the voltage on control terminal 274 controls the voltage generated across resistors 268, 270, and thus the gain of VCA 266. The control signal on terminal 274 is filtered by capacitors 278, 280 and resistor 282. VCA 266 preferably provides a gain sensitivity of 6 mv/dB. Therefore, the signal present on control terminal preferably varies from 0–6 volts, thus providing a variable voltage of approximately 0–60 mv across resistor 268. This voltage scaling provides a relatively low impedance at control terminal 274 and minimizes the effect of any noise present at control terminal 274. It should be noted that as the voltage across resistor 268 increases, the gain of VCA 266 decreases The present invention contemplates the use of a ±15 volt power supply to provide ample dynamic range capabilities in the system 100. The −15 v voltage source is coupled to VCA 266 through resistor 285 and is adjusted to set the quiescent operating current of VCA 266. In addition, the adjustable voltage divider formed by resistors 284, 286, and variable resistor 288 is adjusted to compensate for symmetry irregularities in the output signal of VCA 266.

The control voltage coupled to control terminal 274 may be generated by virtually any type of voltage source. In the preferred practice it is anticipated that system 100 may be located remotely from a listener. For example, in an automobile, sound systems are frequently located in the trunk of the automobile. Since the present invention anticipates the use of a variable gain center channel, it is anticipated that the control terminal 274 may be coupled to a remote voltage source 275 which may be installed in the passenger compartment of an automobile. One remote voltage source adapted for use with the present invention is shown in FIG. 3C. The remote voltage source 275 comprises a switch 386 having terminals 390, 392 and 394, diodes 388, 400, light emitting diode 402, resistors 404, 406, poteniometer 408 and filter capacitor 410. Resistor 406 and poteniometer 408 are coupled in series between the V+ power supply and form a variable voltage divider 412 with the output of voltage divider 412 coupled to control terminal 274 through protection diode 400.

Terminal 390 of switch 386 is also coupled to the V+ power supply. When terminals 390 and 392 of switch 386 are coupled together, the V+ power supply is coupled to terminal 274 through protection diode 388. This forces transistor 272 to conduct fully, thus forcing VCA 266 into a minimum gain state, effectively disabling the system 100. When terminals 392 and 394 of switch 386 are coupled together, the V+ power supply is coupled to ground through light emitting diode 402 and resistor 206. This illuminates light emitting diode 402 and allows the voltage on terminal 274 to depend on the position of the wiper of potentiometer 408, thereby providing adjustable gain in VCA 266.

Referring again to FIG. 3B, the output of VCA 266 is coupled to current-to-voltage converter 290 which comprises operational amplifier 292, feedback resistor 294 and stabilizing capacitor 296. Current-to-voltage converter 290 converts the current signal output by VCA 266 into a voltage signal processed by the remainder of the system 100. The output of current-to-voltage converter 290 is coupled to the non-inverting input of center level match circuit 108, and the inverting inputs of summing amplifiers 112, 114 through resistors 332, 352, respectively.

Center level match 108 provides a nominal gain of 2 and may be adjusted ±15 db to match the system 100 to various amplifier and speaker systems which may be used with the system 100. For example, in many systems, large speakers and amplifiers may be utilized for the left and right side channels. However, since the center channel is high pass filtered, a smaller transducer may be used in the center channel. The nominal gain of the center channel match 108 is set at 2 so that the overall gain of the center channel composite signal is unity with the side channel signal cancellation limited to a gain of 0.5. The center channel match 108 may be adjusted to compensate for difference in the sensitivity in the components used in the center and side channels thus providing a balanced sound field in the listening environment. The center channel match 108 includes operational amplifier 300 wherein the non-inverting input of operational amplifier 300 is coupled to the output current-to-voltage converter 290 through resistor 298. Gain setting resistors 312, 314, 316 are selected to set the nominal gain of operational amplifier 300 at 2. Capacitor 310 provides high frequency filtering of the output of operational amplifier 300 to stabilize the amplifier 300. A potentiometer 304 is coupled between the respective input terminals of operational amplifier 300 and its wiper is commected to ground through resistor 306 and AC coupling capacitor 308. Potentiometer 304 causes either the input signal or the feedback signal to be partially shunted to ground thereby providing a plus or minus 15 dB gain adjustment of the signal at the output of the amplifier 300. The potentiometer 304 has a center detent to set the gain to 2 (i.e. 6 dB). The output of operational amplifier 300 is coupled to the center channel output terminal 318 through resistor 320 and AC coupling capacitor 322. Capacitor 324 filters noise on center channel output terminal 318. Load resistor 326 provides a discharging path for capacitor 322.

The summing amplifiers 112, 114 are configured as inverting amplifiers which sum the combined L+R center channel signal with the respective inverted left and right side channel signals to eliminate any additional monaural information from being added to the overall sound field. As noted above, the amount of L+R center channel signal cancelled from the side channels is user selectable and is controlled by level control 106. In the preferred practice of the present invention, the maximum side channel cancellation is limited to 0.5, thus providing a minimum center channel separation of 9.5 DB. Center channel separation improves at lesser levels of cancellation.

The inverted output signal of summing amplifiers 112, 114 comprise the left and right side channel signals defined by the equations set forth above. The summing amplifier 112 comprises operational amplifier 330 wherein the inverting input of operational amplifier 330 is coupled to the output of current-to-voltage converter 290 through resistor 332 and to the output of input filter 102 through resistor 333. The non-inverting input of operational amplifier 330 is coupled to system grounds. Gain setting resistor 334 and stabilizing filter capacitor 336 are connected in parallel between the inverting input and output of operational amplifier 330. The output of operational amplifier 330 is coupled to the left side channel output terminal 338 through series resistor 340 and AC coupling capacitor 342. Capacitor 344 filters out noise on channel output terminal 338. Load resistor 346 provides a discharging path for capacitor 344. Similarly, The summing amplifier 112 comprises operational amplifier 350 wherein the inverting input of operational amplifier 350 is coupled to the output of current-to-voltage converter 290 through resistor 352 and to the output of input filter 208 through resistor 353. The non-inverting input of summing amplifier 114 is coupled to system ground. Gain setting resistor 354 and stabilizing filter capacitor 356 are connected in parallel between the inverting input and output of operational amplifier 350. The output of operational amplifier 350 is coupled to the right side channel output terminal 358 through series resistor 360 and AC coupling capacitor 362. Capacitor 364 filters noise on right channel output terminal 358. Load resistor 366 provides a discharging path for capacitor 364.

Figure 4A:
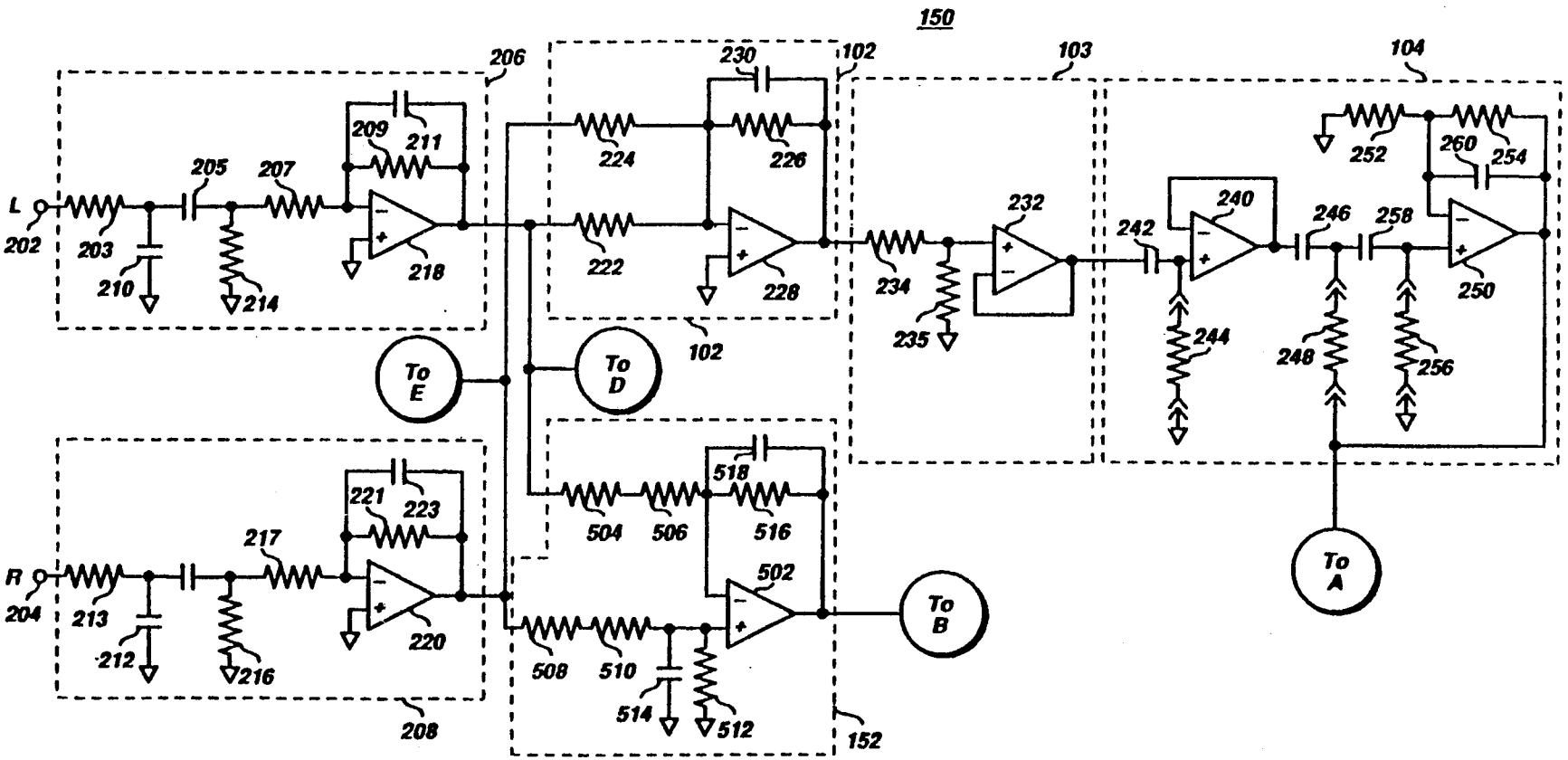
FIG. 4A is a schematic diagram of a portion of the system of FIG. 1B.

Referring now to FIG. 4A, a portion of the system 150 is shown in schematic form. For the sake of clarity, components which perform identical functions in the system 100 bear identical designations and are not further discussed below. In addition to the circuitry of system 100, the system 150 includes difference signal generator 152 for deriving the difference between the left and right input signals. Difference signal generator 152 includes operational amplifier 502 which is disposed with its inverting input coupled to the output of input filter 206 (which comprises the −L input signal) through resistors 504, 506, and its non-inverting input coupled to the output of input filter 208 (which comprises the −R input signal) through resistors 508, 510. Filter capacitor 514 and load resistor 512 are coupled in parallel between the non-inverting input of operational amplifier 502 and system ground. Feedback resistor 516 and stabilizing filter capacitor 518 are coupled in parallel between the inverting input and output of operational amplifier 502. While the difference signal generator 152 is coupled to −R and −L input signals, in practice, by virtue of the input phasing, the output of difference signal circuit 152 comprises a L−R difference signal. While various signal inversions may occur during the detailed operation of the circuitry of FIGS. 4A–4D, the circuit remains functionally equivalent to the circuit shown in FIG. 1B.

Figures 4B, 4D:
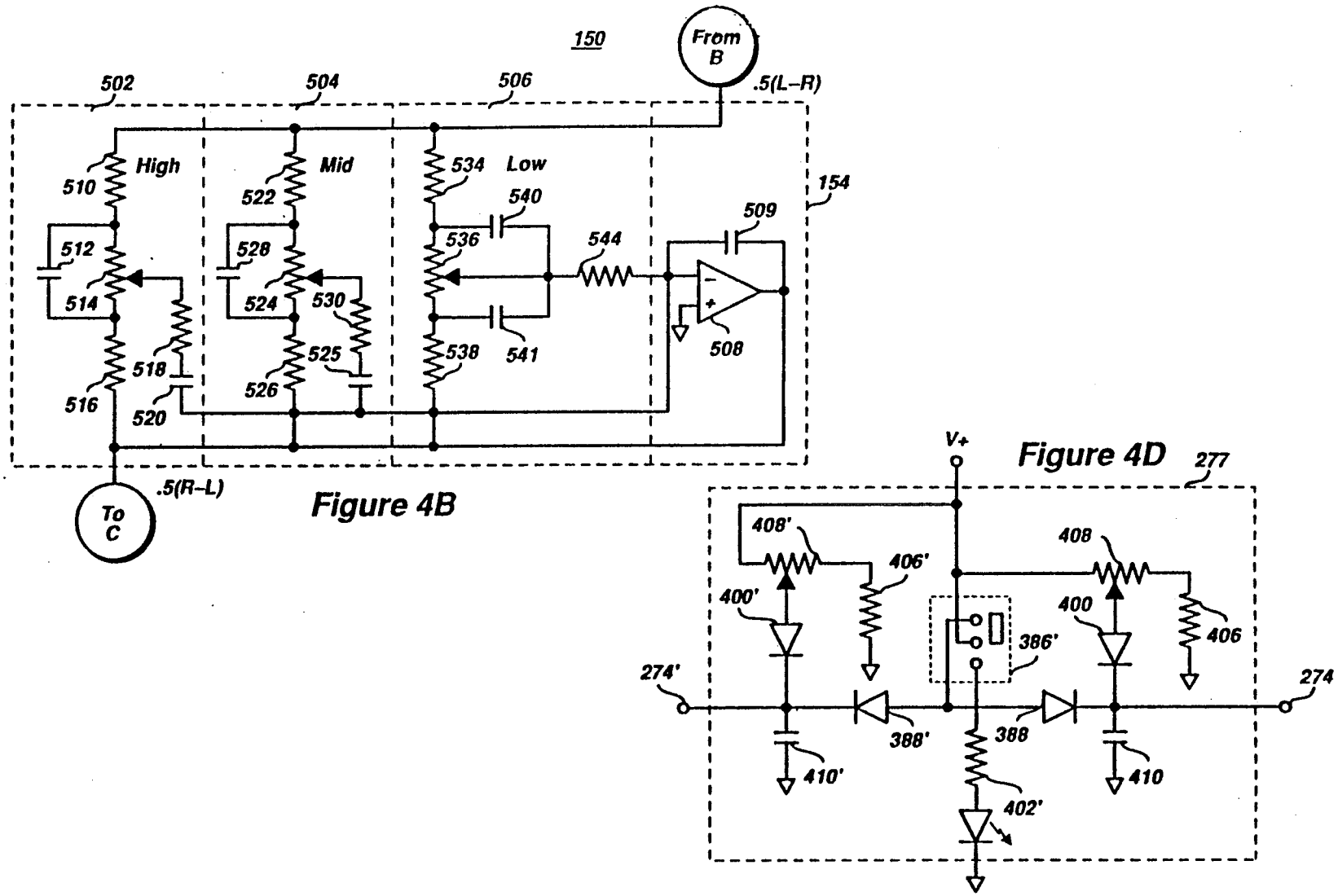
FIG. 4B is a schematic diagram of another portion of the system of FIG. 1B.
FIG. 4D is a schematic diagram of a circuit for remotely controlling the system of FIG 1B.

The output of difference signal generator 152 is coupled to tone control 154 shown in FIG. 4B. The tone control 154 comprises a three stage circuit having high, mid, and low range stages 502, 504, and 506, respectively, disposed in a standard tone control topology wherein the low-range portion 506 is configured as a low-pass equalizer, the high frequency stage 502 is configured as a high-pass equalizer and the mid-range stage 504 is configured as a simple band-pass equalizer. The high frequency stage 502 comprises resistor 510, potentiometer 514, resistors 516 and 518 and capacitors 512, 520 which are selected to provide a variable band pass frequency response ranging from approximately 5 KHz–20 KHz, based on the position of variable resistor 514, with an approximate center frequency of approximately 10 KHz and a boost of approximately ±13 dB. Mid-range stage 504 includes resistor 522, potentiometer 524, resistors 526 and 524 and capacitors 528, 532 which are selected to provide a variable bandpass frequency response ranging from approximately 300 Hz–5 KHz, based on the position of variable resistor 524, with a center frequency of approximately 2 KHz and a boost of approximately ±13 db. The low-frequency stage 506 comprises resistors 534, 538, and 544, potentiometer 536 and capacitors 540, 541 which are selected to provide a a variable frequency response ranging from approximately 20 Hz–300 Hz, based on the position of variable resistor 536, with a center frequency of approximately 40 Hz and a boost of approximately ±21 dB. The output stage of tone control 154 is formed by operational amplifier 508 which is disposed with its non-inverting input coupled to system ground. A stabilizing filter capacitor 509 is coupled between the output and inverting input of operational amplifier 508. The outputs of the respective stages 502, 504, and 506 are coupled to the inverting input of operational 508 which outputs a selectively filtered, 0.5(R−L) difference signal to the level control 156 shown in FIG. 4B.

Figure 4C:
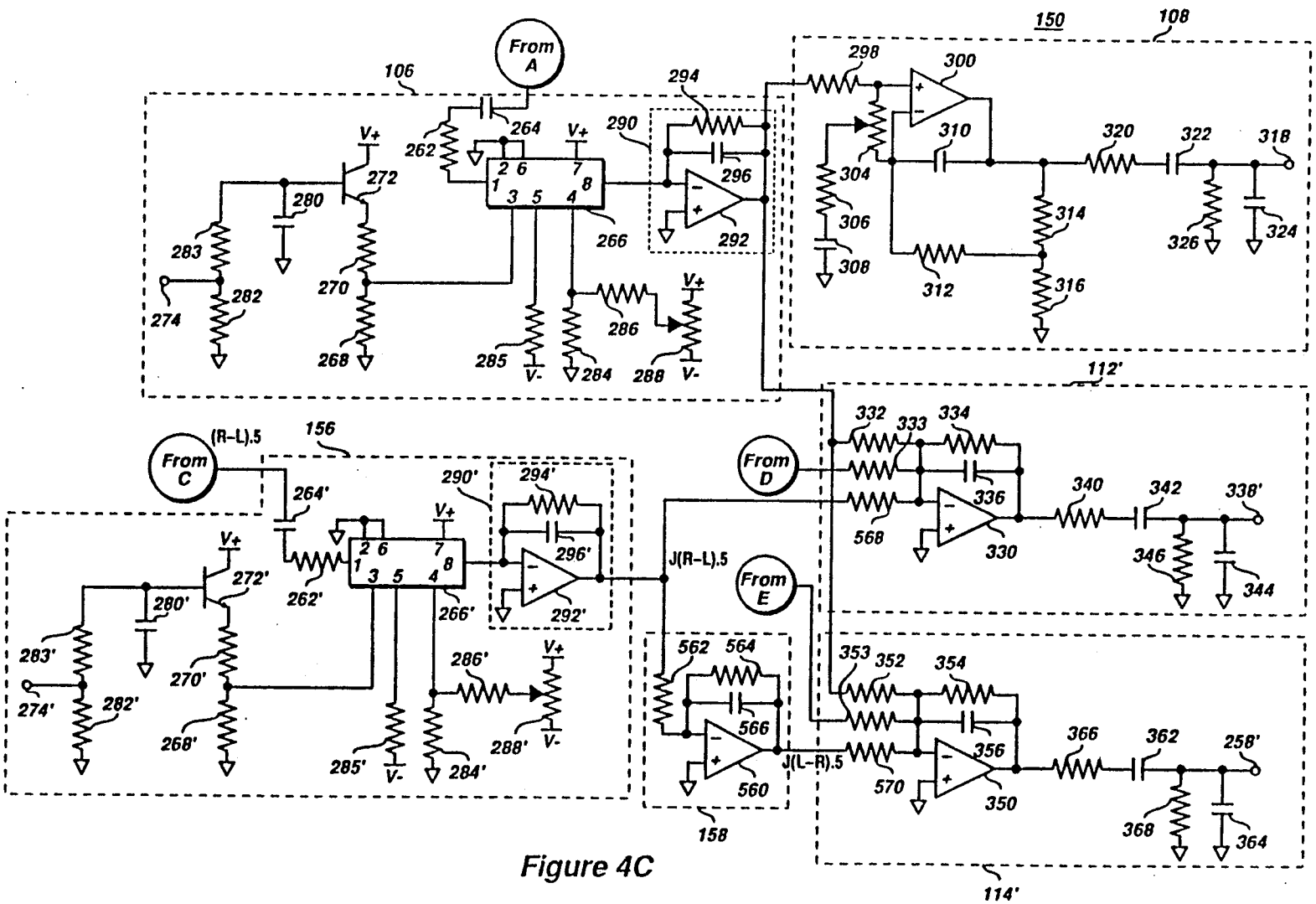
FIG. 4C is a schematic diagram of yet another portion of the system of FIG 1B.

Referring now to FIG. 4C, the output of tone control 154 is coupled to the input of level control 156. The level control 156 is essentially identical to the level control 106, with the exception that the values of resistors 262′ and 294′ are modified to vary the gain of VCA 266′ from 0–3. As in level control 106, a current to voltage converter 290′ converts the current output of VCA 266′ to a voltage signal processed by the remainder of the system 150. The output of current-to-voltage converter 290′ is coupled to inverting buffer amplifier 158 which inverts the phase of output of level control 156 to generate the right channel (L−R) ambience signal. Inverting buffer amplifier 158 is a simple amplification stage including operational amplifier 560, gain control resistors 562, 564 and stabilizing capacitor 566.

Summing amplifiers 112′, 114′ are essentially identical to the summing means 112, 114, with the addition of input resistors 568, 570 which couple the left and right channel ambience signals to the summing nodes of the respective summing amplifiers. Specifically, the input of summing amplifier 114′ is coupled to the output of buffer amplifier 158 (which comprises the right channel ambience signal) through resistor 570, and the input of summing amplifier 112′ is coupled to the output of current-to-voltage converter 290′ (which comprises the right channel ambience signal) through resistor 568. Therefore, the signals present on terminals 338′, 358′ comprise the left and right side channel signal with a variable amount respective left and right ambience signals summed therewith, and a portion of the L+R center channel signal cancelled therefrom.

FIG. 4D is a schematic diagram of a remote control voltage source used for controlling the gain of VCA's 266, 266′ through terminals 274, 274′, respectively. The operation of remote control voltage source 277 is identical to remote control voltage source 275 with the exception that an identical switching network comprising potentiometer 408′, resistor 406′ diodes 388′ and 400′ and capacitor 410′ is coupled in parallel the corresponding components in remote control 275 to generate the control voltage on terminal 274′.

In summary, an improved audio system for use in an automotive environment has been described. The present invention provides means for deriving a center channel of audio information in a stereophonic audio system wherein the center channel is used as a monophonic signal relocator to provide an optimized sound field over a wide area. In addition, a variable portion of the monophonic information output in the center channel is cancelled from the respective side channels to maintain the overall monophonic information in the sound field at a constant level. In yet another embodiment of the present invention, a side channel difference signal is derived to generate left and right ambience signals wherein a variable amount of ambience signal may be injected in the side channels and used in conjunction with the center channel to achieve a desired effect. While the present invention is disclosed as being primarily designed for use in an automobile, those skilled in the art will appreciate that the principles disclosed herein may be applied to virtually any audio system regardless of the available listening environment. Accordingly, other uses and modifications of the present invention will be apparent to persons of ordinary skill in the art without departing from the spirit and scope of the present invention and all of such uses and modifications are intended to fall within the scope of the appended claims.

We claim:

1. An improved audio system comprising:

input means for inputting first and second audio signals;

first summing means for generating a sum signal comprising the sum of said first and second audio signals and for generating a first output signal;

inverting means coupled to said first summing means for generating a phase inverted sum signal;

second summing means coupled to said first audio signal and said phase inverted sum signal for generating a second output signal corresponding to the difference between said first audio signal and said sum signal;

third summing means coupled to said second audio signal and said phase inverted sum signal for generating a third output signal corresponding to the difference between said second audio signal and said sum signal; and means for limiting the gain of said sum signal to 0.5 to preserve substantially all perceptible directional information in said second and third output signals.

2. An improved audio system comprising:

input means for inputting first and second audio signals;

first summing means for generating a sum signal comprising the sum of said first and second audio signals and for generating a first output signal; high pass filter means connected in series with said first summing means either upstream or downstream limiting the frequency range of said first output signal, inverting means coupled to said first summing means for generating a phase inverted sum signal;

second summing means coupled to said first audio signal and said phase inverted sum signal for generating a second output signal corresponding to the difference between said first audio signal and said sum signal;

third summing means coupled to said second audio signal and said phase inverted sum signal for generating a third output signal corresponding to the difference between said second audio signal and said sum signal.

3. An improved audio system comprising:

input means for inputting first and second audio signals;

first summing means for generating a sum signal comprising the sum of said first and second audio signals and for generating a first output signal;

inverting means coupled to said first summing means for generating a phase inverted sum signal;

second summing means coupled to said first audio signal and said phase inverted sum signal for generating a second output signal corresponding to the difference between said first audio signal and said sum signal;

third summing means coupled to said second audio signal and said phase inverted sum signal for generating a third output signal corresponding to the difference between said second audio signal and said sum signal; and means for adjusting the gain of said first summing means so that the magnitude of said first output signal matches the magnitude of said second and third output signals.

4. An improved audio system comprising:

inverting input means for inputting first and second audio signals and outputting inverted first and second audio signals;

first summing means for generating a sum signal comprising the sum of said inverted first and second audio signals;

inverting means for inverting the phase of said sum signal;

second summing means coupled to said inverted first audio signal and said phase inverted sum signal for generating a second output signal; and third summing means coupled to said inverted second audio and said phase inverted sum signal for generating a third output signal.

5. An improved audio system comprising:

input means for inputting first and second channels of audio information;

first summing means for generating a sum signal comprising the sum of said first and second channels of audio information and for generating a first output signal;

inverter means coupled to said first summing means for inverting the phase of said sum signal;

second summing means coupled to said first channel of audio information and the output of said inverter means for generating a second output signal;

third summing means coupled to said second channel of audio information and the output of said first summing means for generating a third output signal;

first, second and third output amplifiers coupled to said first, second, and third output signals, respectively;

first, second, and third transducers coupled to said first second and third output amplifiers, said first, second, and third transducers comprising left, center and right channel output transducers, respectively; and means for matching the sensitivity of said center channel transducer to said left and right channel transducers.

6. An improved audio system comprising:

input means for inputting first and second audio signals;

first summing means for generating a sum signal comprising the sum of said first and second audio signals and for generating a first output signal;

difference signal means for generating a difference signal comprising the difference of said first and second audio signals;

first inverting means coupled to said first summing means for generating a phase inverted sum signal;

second inverting means coupled to said difference signal means for generating a phase inverted difference signal;

second summing means for summing said first audio signal, said phase inverted sum signal, and said difference signal and for generating a second output signal; and third summing means for summing said second audio, said phase inverted sum signal, and said phase inverted difference signal, and for generating a third output signal.

7. An improved method for generating a multidimensional sound field comprising the steps of:

inputting first and second channels of audio information;

summing said first and second channels of audio information to generate a combined audio signal, said combined audio signal having a gain that is no greater than 0.5;

limiting the gain of said combined audio signal to generate a gain limited combined audio signal;

inverting said gain limited combined audio signal;

summing said gain limited inverted combined audio signal with said first channel of audio information to generate a first output channel of audio information;

summing said gain limited inverted combined audio signal with said second channel of audio information to generate a second output channel of audio information;

amplifying said gain limited audio signal to generate a third output channel of audio information;

outputting said first and second and third channels of audio information wherein said third channel audio information comprises a center channel.

8. An improved audio system comprising:

input means for inputting first and second audio signals;

first summing means for generating a sum signal comprising the sum of said first and second audio signals and for generating a first output signal;

remote level control means including a voltage controlled amplifier coupled to said first summing means for amplifying said first output signal by a gain determined by a control signal, and control means located at a remote position for generating said control signal with a manually adjustable amplitude, said control signal being coupled to said voltage controlled amplifier for allowing the amplitude of said first output signal to be adjusted from a remote location, inverting means coupled to said first summing means for generating a phase inverted sum signal;

second summing means coupled to said first audio signal and said phase inverted sum signal for generating a second output signal corresponding to the difference between said first audio signal and said sum signal; and third summing means coupled to said second audio and said phase inverted sum signal for generating a third output signal corresponding to the difference between said second audio signal and said sum signal.

9. The audio system of claim 8 further including means for disabling said first output signal, said means including a manually activated switch connected to a voltage source to said VCA to generate a control signal having an amplitude causing the gain of said VCA to be set at a relatively low amplitude.

* * * * *